US005372613A

United States Patent [19]

Mekonen

[11] Patent Number: 5,372,613

[45] Date of Patent: Dec. 13, 1994

[54] FUEL COMPOSITIONS

[76] Inventor: Kenneth Mekonen, 5601 N. Quincy Ave., Kansas City, Mo. 64119

[21] Appl. No.: 48,679

[22] Filed: Apr. 19, 1993

[51] Int. Cl.[5] ..... C10L 1/32

[52] U.S. Cl. ..... 44/301; 84/358

[58] Field of Search ..... 44/301, 358

[56] References Cited

U.S. PATENT DOCUMENTS

| | | | |
|---|---|---|---|
| 3,105,747 | 10/1963 | Calhoun et al. | 44/354 |
| 4,451,265 | 5/1984 | Schwab | 44/301 |
| 4,504,276 | 3/1985 | Baker | 44/301 |
| 4,744,796 | 5/1988 | Harban et al. | 44/301 |
| 4,877,414 | 10/1989 | McKonen | 44/301 |

*Primary Examiner*—Jacqueline V. Howard
*Attorney, Agent, or Firm*—Thomas M. Scofield

[57] ABSTRACT

New and improved (1) hydrocarbon, per se (nonhydrosol), fuels and compositions plus, additionally, new and improved (2) hydrosol (water/hydrocarbon) fuels and fuel compositions made possible by the development and use of novel additives thereto and additive packages therefor including, for example; (1) improved hydrocarbon fuel compositions, per se, comprising a hydrocarbon fuel including from about 67% to 97.6% by weight of a hydrocarbon combustible fuel selected from the group consisting of gasolines, diesel fuels and heavy fuel oils, such fuel including at least a first additive of at least one organic titanate; such hydrocarbon fuel composition with titanate additionally including one or more secondary but extremely useful additives or catalysts such as (a) a coupling/dispersing agent (surfactant) and (b) a pour point depressant/oxygenator; still further, additional optional, but highly effective, further additives or catalysts including one or more of (c) a toluene aromatic, (d) an alpha (mono) olefin, (e) an alkyl benzene and (f) a toluene aromatic; (2) water/hydrocarbon hydrosol fuel compositions and improvements thereof including at least the first additive of at least one organic titanate, preferably (a) a coupling/dispersing agent (surfactant) and/or (b) a pour point depressant/oxygenator and, still further, preferably one or more of the additives 1(*c*)–(*f*), inclusive, listed above.

90 Claims, No Drawings

FUEL COMPOSITIONS

BACKGROUND OF THE INVENTION

1. Field of Invention

The present invention is concerned with greatly improved fuel compositions having a number of desirable properties such as significantly increased combustion efficiencies so that the fuels are more economical in use. More particularly, it is concerned with such fuels which are supplemented by minor amounts of certain organic titanates. The fuels of the invention include typical hydrocarbon fuels such as gasolines, diesel fuels or heavy fuel oils, such in combination with an appropriate organic titanate additive and also hydrosol fuels containing substantial fractions by weight percentage of water.

2. Description of the Prior Art

A large number of additives have been proposed in the past for use with conventional hydrocarbon fuels such as gasolines, diesel fuel, heavy fuel oils or the like. In many cases, additives have been proposed to remedy specific problems, such as the elimination of knocking through the addition of tetraethyl lead to gasoline. Other agents have also been proposed for the purpose of enhancing combustion efficiency, and hence the work output drive per unit of fuel consumed.

While, as noted, the Prior Art is replete with attempts at providing significant enhancement of combustion efficiency, few if any truly successful additives (and combinations thereof) have been discovered.

Researchers in the art have also proposed that significant quantities of water could be added to liquid hydrocarbon fuels to form a combustible emulsion which would, theoretically, lessen the consumption of the expensive hydrocarbon fuels. Indeed, such proposals extend back to the late 19th Century. Here again, however, no truly successful fuel/water emulsion has been developed in the past, with the limited exception of such disclosed in the U.S. patent application of Kenneth (nmi) Mekonen et al, Ser. No. 06/625,045, filed Jun. 27, 1984 for "Improved Fuel Compositions"now abandoned. Reference also is made to U.S. Pat. No. 4,877,414, issued Oct. 31, 1989 "Fuel Compositions" to Kenneth Mekonen. The subject fuels and fuel/water hydrosol herein disclosed are improvements over such disclosed in the just named currently pending (?) Mekonen patent Application and Mekonen issued patent.

The numerous problems heretofore experienced with such emulsified fuels include the fact that, when relatively large quantities of water are present, the combustion temperature is lowered. Moreover, the presence of substantial water lowers the overall caloric value of the fuel. Finally, many prior disclosed fuel/water emulsions are relatively unstable, tending to separate in two parts over time. Of course, if large quantities of surfactants are employed in such emulsions, the problem of phase separation can be avoided. However, this is inherently a very expensive proposition, and, therefore, in order to be truly economical, the amount of surfactant(s) employed in an emulsified fuel must be relatively small.

OBJECTS OF THE INVENTION

A first and basic object of the subject invention is to make substantial improvements over the disclosures of fuel compositions and additives made in U.S. patent application Mekonen et al, Ser. No. 06/625,045, filed Jun. 27, 1984 for "Improved Fuel Compositions" now abandoned.

A second and also basic object of the instant invention is to make additional substantial improvements over the disclosures of fuel compositions and additives made in the issued U.S. Pat. No. 4,877,414, issued Oct. 31, 1989, to Kenneth Mekonen.

Another object of the invention is to provide improved sets and systems of chemical additives with respect to hydrocarbon fuels per se, and, as well, hydrosol fuels, such latter including both a hydrocarbon component and a major water component.

Another object of the invention is to provide fuel compositions of (1) hydrocarbons and certain additives, as well as (2) certain hydrocarbons, water and additives, wherein less labor is required to manufacture or prepare such fuels (for example, these fuels not being viscous or needing heat in the cold months), wherein there are no nitrogen or sulfur bearing additives used in the fuel and fuel hydrosol compositions and wherein the cost of providing such fuel and fuel hydrosol compositions for use is substantially reduced.

Still another object is to provide such fuel compositions and hydrosol fuel compositions which combust with substantially lowered NOX and SOX emission.

Yet further, another object of the invention is to provide such hydrocarbon fuel and hydrocarbon/hydrosol fuel compositions which require less quantities of surfactants therewith to achieve stable hydrosols and emulsions and remove free water from the systems.

Another object of the invention is to provide a new chemical substance or compound which, in use as a new additive ink hydrocarbon fuel substances and hydrosol hydrocarbon fuel substances, operates, preferably, in combination with additional additives as set forth below, to modify the hydrocarbon or hydrocarbon/hydrosol fuel by increasing its lubricity.

Still another object is to provide such a new additive which, in the hydrocarbon fuel, per se and hydrocarbon/hydrosol fuels improves the load bearing properties of such fuels.

Still another object of the invention is to provide a new additive of the character described wherein such further imparts corrosion resistance to the fuels.

Yet another object of the subject organic titanate additive is, in a hydrosol fuel where a hydrocarbon fuel is mixed with water and surfactants are employed to achieve a dispersion of the water in the fuel, to aid in this stated dispersion in a significant manner.

Yet further, an object of the invention is to provide such an organic titanate additive for hydrocarbon fuels and a hydrocarbon hydrosol fuels wherein the combustion of the fuel operates to form complex titanium halides, nitrides and sulfates, as well as sulfides, the listed formed compounds being insoluble, thereby to avoid ground water seepage.

Other objects of the invention will appear in the course of the following description thereof.

SUMMARY OF THE INVENTION

It has now been discovered that greatly improved fuel compositions can be provided which overcome not only many of the intractable problems discussed above, but also those problems in the above listed Mekonen patent disclosures for "Improved Fuel Compositions" and "Fuel Compositions", respectively. Broadly speaking, the present invention resides in the discovery that use of certain types of organic titanates, typically in relatively minor amounts, alone and in combination with other additive(s) will give significantly enhanced combustion efficiency and other advantages.

HYDROCARBON FUEL, PER SE

In one aspect of the invention, an improved hydrocarbon fuel essentially free of lubricating oil is provided. The fuel comprises (and preferably consists essentially of) a combustible hydrocarbon material preferably one or more surfactants and up to about 0.20% by weight of an organic titanate additive.

The types and amounts of additives herein disclosed serve to increase the work output per unit of fuel obtained, using the improved (additive containing) fuel, as compared with the work output per unit of the identical fuel, except for the absence of the organic titanate additive, etc., therein. The additive is selected from the group consisting of organic titanates containing Titanium-Oxygen-Carbon groups therein.

In preferred forms, the hydrocarbon material is selected from the group consisting of liquid hydrocarbons such as the gasolines, diesel fuels and heavy fuel oils of virtually any specific composition and type. The organic titanate additive (the most preferred organic titanate additive being Tilcom KE-4, detailed below) is advantageously present at a level of about 0.05 to 0.20% by weight and, most preferably in a range of from about 0.100 weight percent. Those skilled in the art will recognize that the specific amount of organic titanate (titanate additive) to be employed in a particular situation depends on the hydrocarbon base material being employed, and the desired characteristics in the ultimate organic titanate supplemented fuel, as well as types, examples and quantities of other additives that may be employed.

Hereinafter the terms "organic titanate" and "titanate" are considered to connote the same class of substances.

In certain forms of the invention, use can also be made of additional additives such as (an) aromatic compound(s) (e.g., toluene and/or selected alkyl benzenes), a pour point depressant, an alpha (mono) olefin and another fuel different than the base hydrocarbon (e.g., diesel fuel in place of a gasoline-based fuel and vice versa) employed.

HYDROSOL FUELS

In another aspect of the invention, liquid hydrosol fuels are provided which broadly include respective quantities of a liquid hydrocarbon combustible fuel, water, at least one surfactant and an additive selected from the group consisting of organic titanates containing Titanium-Oxygen-Carbon groups. Here again, the combustible fuel is advantageously selected from the group consisting of the gasolines, diesel fuels and heavy fuel oils, although other possibilities such as the residual oils may also be employed.

Preferably, the combustible fuel component is present at a level of from about 65% to 75% by weight, and more preferably from about 65% to 90% by weight. On the other hand, the water fraction is preferably present at a level of from about 5% to 25% by weight and, most preferably, from 20% to 25% by weight. In the case of hydrosol fuels, the organic titanate additive may be present at a level up to about 0.20% by weight, and more preferably at a level of from about 0.05% to 0.20% by weight.

Various types of surfactants must be employed in the invention, in order to produce stable hydrosols having good handling and combustion characteristics. Broadly speaking, one or more surfactants can be used, although in practice it has been found that a combination of surfactants is best suited to the purposes of the invention. The surfactants should be present at a level of up to about 2.50% by weight, preferably 1.00% to 2.50% by weight, but in this case, the prime consideration is one of cost. That is, an excess amount of surfactant (s) may not deleteriously effect the characteristic of the fuel, but such would be impractical from an economic standpoint. Other additives, as previously mentioned, may be employed.

DESCRIPTION OF THE PREFERRED EMBODIMENTS

In the production of non-hydrosol fuels in accordance with the invention, the selected organic titanate is simply mixed with the hydrocarbon base fuel and surfactant and what other additives are selected at the desired level of addition. The most preferred hydrocarbon bases are the gasolines and diesel fuels (particularly #2 diesel fuel), whereas the most preferred organic titanate is dibutoxy titanium-bis-(ethyl acetoacetate) or the Tioxide Specialties, Limited, product, Tilcom KE-4. The latter is dissolvable in the hydrocarbon fuel being used, and if not, another, soluable organic titanate should be used.

One particular commercially available compound, named just above, dibutoxy titanium-bis-(ethyl acetoacetate), is used to good effect in the subject invention, and is commercialized as Tilcom KE-4 by Tilcom (Tioxide Chemicals, Ltd., of Billingham, Cleveland TS23 1PS England/Registered Office: Tioxide House, 137–143 Hammersmith Road, London W14 0QL, England). This material is a yellow/orange liquid with a titanium weight percent content of 10.6, a density in grams per millileter at 25 degrees C of 1.090, a viscosity (mPa.s) of 28 and a flashpoint Degree C(cc) of 45. The chemical and physical properties of this product are set forth in a publication from the manufacturer (Tilcom) entitled "Tioxide Specialties, Ltd./Safety Data Sheet/-Tilcom KE-4". This data sheet of six pages, setting forth the chemical, physical and safety properties of this product, is incorporated by reference herein. This compound is from the chemical family of titanium chelates and the formula, chemical name and synonyms therefore are given in said reference.

Additionally, reference is made to the catalog or brochure (32 pages) entitled "*Tioxide Chemicals-Tilcom Products-Organic Titanates, Their Chemistry And Industrial Applications.*" This work is also incorporated herein by reference as are all the Tilcom Safety Data sheets of the compounds listed on Pages 10 and 11 thereof.

The presently most preferred non-hydrosol fuel composition consists of essentially about 98% of base hydrocarbon fuel, particularly gasoline or #2 diesel oil, along with up to 0.20% of organic titanate(s) mixed therein, such optionally but preferably with at least an alkyl benzene up to the same level. A specific example of a preferred alkyl benzene is Zerol 300 (dimerized propylene tetramer). Surfactants preferably are present.

In the context of hydrosol fuels the most preferred fuel additives include, at least, Tilcom KE-4, per se, along with the substantial fraction of water in order to form a water-in-fuel hydrosol. Hydrosol creating or aiding surfactant(s) or the equivalent must also be present. Here again, a wide variety of fuels can be employed, but the presently preferred hydrocarbon base fuels include members taken from the group consisting of the gasolines, diesel fuels and heavy fuel oils. Numbers 1, 2, 3, 4, 5 and 6 oils may be employed. Of these, Numbers 1, 2 and 3 are regarded as diesel fuels, while Numbers 4, 5, and 6 are regarded as heavy fuel oils.

In terms of surfactants, the most preferred combination includes, respectively, minor amounts of three coupling/dispersing agents, specifically: Emsorb 2502 (SSO Sorbitan Sesquioleate), Emerest 2632 PEG-300 Mono oleate, Emerest 2648 PEG-400 Di-Oleate and Trycol DA-6 (POE (6) Decyl Alcohol). Emery Industries data sheets are in hand on these compounds. Sorbitan monotallate and sorbitan ditallate also may be used, as well as 9-Octadenoic acid (with calcium, magnesium, zinc or aluminum salts) to replace one of the listed coupling/dispersing agents.

In addition, however, various other surfactants and kinds of surfactants can be used to good effect in the invention. As those skilled in the art will readily perceive, however, an extremely large number of specific surfactants and combinations thereof can be used in the invention as long as the aims thereof are achieved.

TABLE I

| PREFERRED HYDROSOL FUEL CONSTITUENTS | RANGE | MOST PREFERRED |
|---|---|---|
| 1. #2 Diesel Oil (Or Gasoline) | 67.80–91.40 | 78.00 |
| 2. Water | 5.00–25.00 | 20.00 |
| 3. Total Coupling/Dispersing Agents | 1.00–2.50 | 0.80 |
| 4. Emsorb-2502 (SSO Sorbitan Sesquioleate) | 0.15–1.05 | 0.30 |
| 5. Emerest-2632 PEG-300 Mono oleate | 0.075–0.20 | 0.150 |
| 6. Emerest-2648 PEG-400 Di-Oleate | 0.075–0.20 | 0.150 |
| 7. Trycol DA-6 | 0.10–0.20 | 0.10 |
| 8. (Mono olefin)Gulftene-18-Octene | 0.05–0.20 | 0.10 |
| 9. Amsco Solv-EE | 0.05–0.20 | 0.10 |
| 10. Toluene (3-methyl pentane) | 0.40–3.00 | 0.80 |
| 11. (Alkyl Benzene) Zerol-300 (Dimerized propylene tetramer) | 0.05–0.20 | 0.10 |
| 12. Tilkom KE-4 (Di-iso-propoxy-titanium bis(ethyl) 3-oxobutanoate) | 0.05–0.20 | 0.10 |

In order to produce hydrosol fuels in accordance with the invention, it is preferred to first mix the surfactant(s) to be employed, whereupon these surfactant(s) are added to the hydrocarbon base material (with sufficient mixing to insure complete dissolution) At this point, the water is added, again with mixing to assure a relatively even dispersion. The preferred surfactant package disclosed herewithin above greatly facilitates the mixing procedure, preferably using an in-line static mixer or a homogenizer. In the case of gasoline based hydrosols, it is estimated that the particle diameter of the water in the hydrosol is 10(−3) to 10(−4) microns.

In addition to the hydrocarbon fuel, water, coupling/dispersing agents (surfactants) and an organic titanate (one or more) and optionally an alkyl benzene, it should be noted that a pour point depressant, here Amsco Solve-EE (2-methoxyl ethanol) may be added in a weight range of 0.05% to 0.2%. This acts as a pour point depressant/oxygenate. Yet further, toluene (3-methyl pentane) may be added in the weight range of 0.4% to 3.0%. Likewise, as above noted, an alkyl benzene, such as Zerol-300 (dimerized propylene tetramer, average mol. wt. of 330) may be employed in the amount of 0.05 to 0.20% weight percent. In the event that Tilcom KE-4, toluene and Zerol-300 are all three present, the total weight percent of the sum thereof should not exceed 3.4% by weight. Alternatively, Tilcom KE-4 and/or other organic titanate(s) may be combined with either toluene alone or Zerol-300 (alkyl benzene) alone, again with the optimum weight percent range thereof from 0.05% to 3.4% by weight.

Merely by itself, in (a) a basically hydrocarbon fuel, per se, or (b) a hydrosol fuel, without any other additives, the use of the titanates or titanate operates to (1) lower noxious and toxic gas emissions from combustion of such fuels, (2) require less quantities of surfactants to achieve the necessary, stable hydrosol and/or emulsions in the hydrosol fuels and remove free water from the hydrocarbon system, per se, (3) modify the hydrocarbon, per se, or hydrocarbon/hydrosol fuels significantly by increasing their lubricity; (4) improve the load bearing properties of both hydrocarbon per se, and hydrocarbon/hydrosol fuels; (5) impart corrosion resistance to the fuels; (6) substantially aid surfactants which are employed to achieve a dispersion of water in the hydrocarbon part of the fuel in a significant manner, also particularly in the hydrosol type fuel; (7) produce complex titanium halides, nitrides and sulfates, as well as sulfides, on combustion, which listed compounds, being insoluble in water, avoid ground water seepage. Still further, the use of organic titanates, typically in relatively minor amounts, give significantly enhanced fuel combustion efficiency. Such also cooperates with the other listed additives to most strongly achieve these goals.

While various types of surfactants can be employed in the invention, in order to produce stable hydrosols having good handling and combustion characteristics, those listed in Table I are most preferred. Numbers 4 (Emsorb 2502) and 7 (Trycol DA-6 (POE (6) Decyl Alcohol) are the most important of the group listed.

Broadly speaking, one or more surfactants can be used, although in practice it has been found that a combination of surfactants is best suited to the purposes of the invention. The surfactants should be present at a level of up to about 5 % by weight, most preferably 1.0% to 2.5 % by weight. In this case, the prime consideration is still one of cost. That is, an excess amount of surfactant may not negatively effect the characteristic of the fuel, but would be impractical from an economic standpoint. In the basic combination of the invention, that is, a hydrocarbon fuel plus a titanate or a hydrosol fuel plus a titanate, the presence of the surfactants is necessary in the case of the hydrosol fuel (to effect the hydrosol) and preferred in the hydrocarbon fuel because such make hydrosol out of any free water present.

Additional single, paired, tripled, quadrupled, etc., additives in a hydrosol fuel, besides the surfactants and the organic titanate include, as options: (1) from 0.40% to 3.0% by weight of a toluene aromatic; (2) a pour point depressant/oxygenate present in the amount of 0.05 % to 0.20%; (3) from about 0.1% up to about 3.4 % by weight of an additive selected from the group consisting of alpha (mono) olefins and alkyl benzenes; (4) an alpha (mono) olefin, per se, present in the preferred range of about 0.1% by weight; (5) an alkyl benzene, per se, present in the preferred range of 0.1% by weight. If both mono olefin and alkyl benzenes are present, the olefin typically has from 7 to 18 recurring $CH_2$ monomers therein and the alkyl benzenes have from 7 to 15 recurring $CH_2$ monomers therein. Each addition or additional additive aids the combination, whereby such a hydrosol fuel, with the optimum package of additives will have (1) an organic titanate, (2) surfactants, (3) a toluene aromatic, (4) a pour point depressant/oxygenate, (5) one or both of (preferably both) alpha olefins and alkyl benzenes.

The hydrocarbon fuel, per se, will include (1) an organic titanate, and, optionally, (2) surfactants, (3) a toluene aromatic, (4) a pour point depressant/oxygenate and (5) one or both of alpha olefins and alkyl benzenes (both preferred).

From either fuel, one can remove one or more of the alpha olefin, alkyl benzene, both alpha olefins and alkyl benzenes, the pour point depressant/oxygenate and/or the toluene aromatic. In the hydrocarbon fuel, per se, the surfactants can be (but are preferably not) removable.

Calcium hydroxide as a chemical additive is not used in this formulation, whether the water supplied in the hydrosol fuel is hard or soft. Any use of calcium hydroxide to aid in controlling noxious emissions in the burning of the hydrosol fuel is substituted for by the presence of the organic titanates or titanate.

Looking at Table I, the Gulftene-18-Octene, toluene and alkyl benzene are all basically present for added power in both types of fuels.

The organic titanate and an alkyl benzene, in combination, are critical constituents of both the hydrocarbon type fuels, per se, and the hydrosol fuels disclosed. They obtain critical power increase from cleavage of the hydrocarbon molecule. The use of the organic titanate, per se, in sufficient amount, permits the omission of the alkyl benzene. On the other hand, the alkyl benzene does not adequately substitute for the organic titanate presence.

With respect to item 9 in Table I, Amsco Solv-EE, this acts as a pour point depressant/oxygenate for cold climates. This or some equivalent is necessary to avoid freeze out. Many other useful pour point depressant exist, for example, the Dow Chemical, Michigan, Dowanol Ether Developments (glycol ethers).

The typical effect of the alpha olefin is to obtain critical power increase from cleavage of the hydrocarbon compound molecules. Toluene also offers critical power increase, and is cheaper than the alpha olefin, toluene also aiding in controlling the viscosity of the hydrosol. The alkyl benzene is particularly present for improving lubricity of the fuel and cleavage of the molecules, aiding the hydrosol.

This invention provides groups, sets and systems of chemical additives which, in application and use, remarkably improve both (1) hydrocarbon fuels, per se, as well, (2) hydrosol fuels including a hydrocarbon component and a major water component.

The subject invention also has disclosed and provided numerous fuel compositions of (1) hydrocarbons, per se, and chemical additives therefor, as well as (2) hydrocarbons, water and such additives, (a) wherein less labor is required to manufacture, prepare and maintain such fuels (for example, these fuels not being viscous or needing heat in cold zones or cold months of the year), (b) wherein there are no nitrogen or sulfur bearing additives used in the fuels, per se, or fuel hydrosol (water compositions) and yet (c) wherein the cost of providing such hydrocarbon/additive and hydrosol/additive compositions are substantially reduced, yet providing enhanced results.

The invention has provided such (1) fuel, per se, compositions with additives and (2) hydrosol water/fuel compositions with additives which combust with substantially lower toxic and noxious emissions. Still further, the subject invention provides both fuel and hydrosol compositions with additives requiring less quantities of surfactants to produce an effective hydrosol, elements of the additives aiding the surfactants in hydrosol production and maintenance. Further, when it is desired to add surfactants to the particular fuel with additives, again, less quantifies of surfactants are required for advantageous results.

In short, a key, critical change to certain additive complexes, specifically, the use of organic titanates, has vitalized and improved many of the actions of the original additive complex, as well as providing new advantages and effects from the organic titanate additive.

From the foregoing, it will be seen that this invention is one well adapted to obtain all of the ends and objects hereinabove set forth, together with other advantages which are obvious and which are inherent to the fuel compositions.

It will be understood that certain features and subcombinations are of utility and may be employed without reference to other features and sub-combinations as above stated. This is contemplated by and is within the scope of the claims.

I claim:

1. A hydrosol fuel comprising from about 67% to 94% by weight of a hydrocarbon combustible fuel selected from the group consisting of the gasolines, diesel fuels and heavy fuel oils, from 5% to 25% by weight of water, at least one surfactant operable to create a hydrosol with the fuel and water present in the range of 1.0 to 2.5 weight percent, and from 0.1 up to about 0.40% by weight of an additive comprising an organic titanate.

2. A fuel as in claim 1 including from 0.40% to 3.0% by weight of a toluene aromatic.

3. A fuel as in claim 1 including a pour point depressant/oxygenate present in the amount of 0.05 to 0.20 weight percent.

4. A fuel as in claim 1 wherein the hydrocarbon fuel is present in the preferred range of about 78% by weight.

5. A hydrosol fuel as in claim 1 wherein the water is in the preferred range of about 20% by weight.

6. A fuel as in claim 1 wherein the hydrocarbon fuel is present in the preferred range of about 78% by weight and the water is in the preferred range of about 20% by weight.

7. A fuel as in claim 1 including from about 0. 1% up to about 3.4% by weight of an additive selected from the group consisting of alpha (mono) olefins and alkyl benzenes.

8. A fuel as in claim 7 wherein both olefins and alkyl benzenes are present and the olefin has from seven to eighteen recurring $CH_2$ monomers therein and the alkyl benzenes have from seven to fifteen recurring $CH_2$ monomers therein.

9. A hydrosol fuel as in claim 1 wherein the total surfactant agents are present in a preferred range of about 0.90% by weight.

10. A fuel as in claim 1 wherein an alpha (mono) olefin is present in preferred range of about 0. 1% by weight.

11. A fuel as in claim 1 wherein an alkyl benzene is present in the preferred range of about 0.1% by weight.

12. A fuel as in claim 1 wherein the organic titanate is present in a preferred range of about 0.1% by weight.

13. A hydrosol fuel such as in claim 1 wherein the fuel contains a toluene aromatic and at least one organic titanate, in combination, up to about 3.4% by weight.

14. A fuel as in claim 1 wherein a toluene aromatic and an alkyl benzene are present, the said toluene aromatic and alkyl benzene being from 0.5% up to about 3.4% by weight of the fuel.

15. A hydrosol fuel as in claim 1 including a mixture of alpha olefin and alkyl benzene, each of the olefin and benzene having seven to fifteen recurring $CH_2$ monomers therein, such being present in an amount up to about 0.4 % by weight and, further, a toluene aromatic is present in the amount of about 3.0 weight percent.

16. A fuel as in claim 1 containing additionally a toluene aromatic and alpha mono olefins in an amount up to about 3.4% by weight.

17. A hydrosol fuel comprising from about 67% to 94% by weight of hydrocarbon combustible fuels selected from the group consisting of the gasolines, diesel fuels and heavy fuel oils, from 5% to 25% by weight of water, at least one surfactant operable to create a hydrosol with the fuel and water present in the range of about 1.0% to 2.5% by weight, a pour point depressant/oxygenate in the range of 0.05% to 0.20% by weight, and from 0.1% by weight up to about 0.20% by weight of an additive comprising an organic titanate.

18. A fuel as in claim 8 including an alpha olefin having seven to fifteen recurring $CH_2$ monomers therein present in the range of 0.1% to 0.4% by weight, the fuel also including a toluene aromatic in the amount of 0.4% to 3.0% by weight.

19. A fuel as in claim 18 wherein the additive is an alkyl benzene present in the quantity of 0.1% to 0.4% by weight and a toluene aromatic is also present in the mount of 0.4% to 3.0% by weight.

20. A fuel as in claim 17 including from 0.40% to 3.0% by weight of a toluene aromatic.

21. A fuel as in claim 17 wherein the hydrocarbon fuel is present in the preferred range of about 78% by weight.

22. A hydrosol fuel as in claim 17 wherein the water is in the preferred range of about 20% by weight.

23. A fuel as in claim 17 wherein the hydrocarbon fuel is present in the preferred range of about 78% by weight and the water is in the preferred range of about 20% by weight.

24. A fuel as in claim 17 including from about 0.1% up to about 3.4% by weight of an additive selected from the group consisting of alpha (mono) olefins and alkyl benzenes.

25. A fuel as in claim 17 wherein both olefins and alkyl benzenes are present and the olefin has from seven to eighteen recurring $CH_2$ monomers therein and the alkyl benzenes have from seven to fifteen recurring $CH_2$ monomers therein.

26. A hydrosol fuel as in claim 17 wherein the total surfactant agents are present in a preferred range of about 0.90% by weight.

27. A fuel as in claim 17 wherein an alpha (mono) olefin is present in preferred range of about 0.1% by weight.

28. A fuel as in claim 17 wherein an alkyl benzene is present in the preferred range of about 0.1% by weight.

29. A fuel as in claim 17 wherein the organic titanate is present in a preferred range of about 0.1% by weight.

30. A hydrosol fuel such as in claim 17 wherein the fuel contains a toluene aromatic and at least one organic titanate, in combination, up to about 3.4% by weight.

31. A fuel as in claim 17 wherein a toluene aromatic and an alkyl benzene are present, the said toluene aromatic and alkyl benzene being from 0.5% up to about 3.4% by weight of the fuel.

32. A hydrosol fuel as in claim 17 including a mixture of alpha olefin and alkyl benzene, each of the olefin and benzene having seven to fifteen recurring $CH_2$ monomers therein, such being present in an amount up to about 0.4% by weight and, further, a toluene aromatic is present in the amount of about 3.0 weight percent.

33. A fuel as in claim 17 containing additionally a toluene aromatic and alpha mono olefins in an mount up to about 3.4% by weight.

34. A hydrocarbon fuel comprising from about 67% to 97.6% by weight of a hydrocarbon combustible fuel selected from the group consisting of the gasolines, diesel fuels and heavy fuel oils, at least one surfactant operable to create a hydrosol with the fuel and any water present in the range of 1.0% to 2.5% by weight and from 0.1% up to about 0.20% by weight of an additive comprising an organic titanate.

35. A fuel as in claim 34 including from 0.40% to 3.0% by weight of a toluene aromatic, and an additive selected from the group consisting of alpha olefins and alkyl benzenes being present in the range of 0.1% to 0.4% by weight.

36. A fuel as in claim 34 including a pour point depressant present in the amount of 0.05% to 0.20% by weight.

37. A fuel as in claim 34 wherein the hydrocarbon fuel is present in the preferred range of about 98% by weight.

38. A fuel as in claim 34 wherein an alpha olefin is present in the preferred range of about 0.1% by weight.

39. A fuel as in claim 34 wherein an alkyl benzene is present in the preferred range of about 0.1% by weight.

40. A fuel as in claim 34 including from 0.40% to 3.0% by weight of a toluene aromatic.

41. A fuel as in claim 34 including a pour point depressant/oxygenate present in the amount of 0.05 to 0.20 weight percent.

42. A fuel as in claim 34 including from about 0.1% up to about 3.4% by weight of an additive selected from the group consisting of alpha (mono) olefins and alkyl benzenes.

43. A fuel as in claim 34 wherein both olefins and alkyl benzenes are present and the olefin has from seven to eighteen recurring $CH_2$ monomers therein and the alkyl benzenes have from seven to fifteen recurring $CH_2$ monomers therein.

44. A hydrosol fuel as in claim 34 wherein the total surfactant agents are present in a preferred range of about 0.90% by weight.

45. A fuel as in claim 27 wherein the organic titanate is present in a preferred range of about 0.1% by weight.

46. A hydrosol fuel such as in claim 34 wherein the fuel contains a toluene aromatic and at least one organic titanate, in combination, up to about 3.4% by weight.

47. A fuel as in claim 34 wherein a toluene aromatic and an alkyl benzene are present, the said toluene aromatic and alkyl benzene being from 0.5% up to about 3.4% by weight of the fuel.

48. A hydrosol fuel as in claim 34 including a mixture of alpha olefin and alkyl benzene, each of the olefin and benzene having seven to fifteen recurring $CH_2$ monomers therein, such being present in an amount up to about 0.4% by weight and, further, a toluene aromatic is present in the amount of about 3.0 weight percent.

49. A fuel as in claim 34 containing additionally a toluene aromatic and alpha mono olefins in an amount up to about 3.4% by weight.

50. A hydrocarbon fuel comprising from about 67% to 97.6% by weight of a hydrocarbon combustible fuel selected from the group consisting of the gasolines, diesel fuels and heavy fuel oils, at least one surfactant operable to create a hydrosol with the fuel and any water present, such surfactant present in the range of 1.0% to 2.5% by weight, a pour point depressant/oxygenate in the range of 0.05% to 0.2% by weight and from 0.1% by weight up to about 0.2% by weight of an additive comprising an organic titanate.

51. A fuel as in claim 50 including from 0.40% to 3.0% by weight of a toluene aromatic, and an additive selected from the group consisting of alpha olefins and alkyl benzenes being present in the range of 0.1% to 0.4% by weight.

52. A fuel as in claim 50 wherein the hydrocarbon fuel is present in the preferred range of about 98% by weight.

53. A fuel as in claim 50 wherein an alpha olefin is present in the preferred range of about 0.1% by weight.

54. A fuel as in claim 50 wherein an alkyl benzene is present in the preferred range of about 0.1% by weight.

55. A fuel as in claim 50 including from 0.40% to 3.0% by weight of a toluene aromatic.

56. A fuel as in claim 50 including a pour point depressant/oxygenate present in the amount of 0.05 to 0.20 weight percent.

57. A fuel as in claim 50 including from about 0.1% up to about 3.4% by weight of an additive selected from the group consisting of alpha (mono) olefins and alkyl benzenes.

58. A fuel as in claim 50 wherein both olefins and alkyl benzenes are present and the olefin has from seven to eighteen recurring $CH_2$ monomers therein and the alkyl benzenes have from seven to fifteen recurring $CH_2$ monomers therein.

59. A hydrosol fuel as in claim 50 wherein the total surfactant agents are present in a preferred range of about 0.90% by weight.

60. A fuel as in claim 50 wherein the organic titanate is present in a preferred range of about 0.1% by weight.

61. A hydrosol fuel such as in claim 50 wherein the fuel contains a toluene aromatic and at least one organic titanate, in combination, up to about 3.4% by weight.

62. A fuel as in claim 50 wherein a toluene aromatic and an alkyl benzene are present, the said toluene aromatic and alkyl benzene being from 0.5% up to about 3.4% by weight of the fuel.

63. A hydrosol fuel as in claim 50 including a mixture of alpha olefin and alkyl benzene, each of the olefin and benzene having seven to fifteen recurring $CH_2$ monomers therein, such being present in an amount up to about 0.4% by weight and, further, a toluene aromatic is present in the amount of about 3.0 weight percent.

64. A fuel as in claim 50 containing additionally a toluene aromatic and alpha mono olefins in an amount up to about 3.4% by weight.

65. A hydrosol fuel comprising from about 67% to 94% by weight of a hydrocarbon combustible fuel selected from the group consisting of the gasolines, diesel fuels and heavy fuel oils, from 5% to 25% by weight of water, at least one surfactant operable to create a hydrosol with the fuel and water present in the range of 1.0 to 2.5 weight percent, from about 0.40% to 3.0% by weight of a toluene aromatic, a pour point depressant/oxygenate in the amount of 0.05 to 0.20 weight percent;

from about 0.1% up to about 3.4% by weight of an additive selected from the group consisting of alpha (mono) olefins and alkyl benzenes;

and from 0.1 up to about 0.40 percent by weight of an additive comprising an organic titanate.

66. A hydrosol fuel as in claim 65 wherein the hydrocarbon fuel is present in the preferred range of about 78% by weight and the water as in the preferred range of about 20% by weight.

67. A fuel as in claim 65 wherein both olefins and alkyl benzenes are present and the olefin has from seven to eighteen recurring $CH_2$ monomers therein and the alkyl benzenes have from seven to fifteen recurring $CH_2$ monomers therein.

68. A fuel as in claim 65 wherein any alpha (mono) olefin present is so present in a preferred range of about 0.1% by weight and any alkyl benzene present is so present in the preferred range of about 0.1% by weight.

69. A fuel as in claim 65 wherein the organic titanate is present in a preferred range of about 0.1% by weight.

70. A hydrocarbon fuel comprising from about 67% to 97.6% by weight of a hydrocarbon combustible fuel selected from the group consisting of the gasolines, diesel fuels and heavy fuel oils, at least one surfactant operable to create a hydrosol between the hydrocarbon and any water present in the range of 1.0 to 2.5 weight percent, from 0.4% to 3.0% by weight of a toluene aromatic;

a pour point depressant/oxygenate present in the amount of 0.05 to 0.20 weight percent;

from about 0.1% up to about 3.4% by weight of an additive selected from the group consisting of alpha (mono) olefins and alkyl benzenes;

and from about 0.1% to about 0.40% by weight of an additive comprising an organic titanate.

71. A fuel as in claim 70 wherein the hydrocarbon fuel is present in the preferred range of about 97.9% by weight.

72. A fuel as in claim 70 wherein the total surfactant is present in the preferred range of about 0.9% by weight.

73. A fuel as in claim 70 wherein any alpha olefin present is present in a preferred range of about 0.1% by weight.

74. A fuel as in claim 70 where any alkyl benzene present is so present in a preferred range of about 0.1% by weight

75. A hydrocarbon fuel comprising from about 67% to 97.6% by weight of a hydrocarbon combustible fuel selected from the group consisting of the gasolines, diesel fuels and heavy fuel oils, there being from about 0.1% up to about 0.2% by weight of an additive thereto comprising and organic titanate.

76. A fuel as in claim 75 including from 0.40% to 3.0% by weight of a toluene aromatic, and an additive selected from the group consisting of alpha olefins and alkyl benzenes being present in the range of 0.1% to 0.4% by weight.

77. A fuel as in claim 75 including a pour point depressant present in the amount of 0.05% to 0.20% by weight.

78. A fuel as in claim 75 wherein the hydrocarbon fuel is present in the preferred range of about 98% by weight.

79. A fuel as in claim 75 wherein an alpha olefin is present in the preferred range of about 0.1% by weight.

80. A fuel as in claim 75 wherein an alkyl benzene is present in the preferred range of about 0.1% by weight.

81. A fuel as in claim 75 including from 0.40% to 3.0% by weight of a toluene aromatic.

82. A fuel as in claim 75 including a pour point depressant/oxygenate present in the amount of 0.05 to 0.20 weight percent.

83. A fuel as in claim 75 including from about 0.1% up to about 3.4% by weight of an additive selected from the group consisting of alpha (mono) olefins and alkyl benzenes.

84. A fuel as in claim 75 wherein both olefins and alkyl benzenes are present and the olefin has from seven to eighteen recurring $CH_2$ monomers therein and the alkyl benzenes have from seven to fifteen recurring $CH_2$ monomers therein.

85. A fuel as in claim 75 wherein a plurality of surfactant agents are present in a preferred range of about 0.90 by weight, such operable to create a hydrosol with the fuel and any water therein.

86. A fuel as in claim 75 wherein the organic titanate is present in a preferred range of about 0.1% by weight.

87. A hydrosol fuel such as in claim 75 wherein the fuel contains a toluene aromatic and at least one organic titanate, in combination, up to about 3.4% by weight.

88. A fuel as in claim 75 wherein a toluene aromatic and an alkyl benzene are present, the said toluene aromatic and alkyl benzene being from 0.5% up to about 3.4% by weight of the fuel.

89. A hydrosol fuel as in claim 75 including a mixture of alpha olefin and alkyl benzene, each of the olefin and benzene having seven to fifteen recurring $CH_2$ monomers therein, such being present in an amount up to about 0.4% by weight and, further, a toluene aromatic is present in the amount of about 3.0 weight percent.

90. A fuel as in claim 75 containing additionally a toluene aromatic and alpha mono olefins in an amount up to about 3.4% by weight.

* * * * *